US010327523B2

(12) United States Patent
Liang

(10) Patent No.: US 10,327,523 B2
(45) Date of Patent: Jun. 25, 2019

(54) COLLAPSIBLE LUGGAGE

(71) Applicant: Joseph Liang, Ping-Tung Hsien (TW)

(72) Inventor: Joseph Liang, Ping-Tung Hsien (TW)

( * ) Notice: Subject to any disclaimer, the term of this patent is extended or adjusted under 35 U.S.C. 154(b) by 222 days.

(21) Appl. No.: 15/231,501

(22) Filed: Aug. 8, 2016

(65) Prior Publication Data

US 2017/0340076 A1 Nov. 30, 2017

(30) Foreign Application Priority Data

May 31, 2016 (CN) ..... 2016 2 0517522 U

(51) Int. Cl.

| | |
|---|---|
| ***A45C 13/30*** | (2006.01) |
| ***A45C 7/00*** | (2006.01) |
| ***A45C 5/14*** | (2006.01) |
| ***A45C 13/10*** | (2006.01) |
| ***A45C 13/26*** | (2006.01) |
| ***A45C 13/36*** | (2006.01) |

(52) U.S. Cl.

CPC ..... *A45C 7/0036* (2013.01); *A45C 5/14* (2013.01); *A45C 13/103* (2013.01); *A45C 13/262* (2013.01); *A45C 13/30* (2013.01); *A45C 13/36* (2013.01); *A45C 2013/267* (2013.01)

(58) Field of Classification Search

CPC ..... A45C 5/14; A45C 13/262; A45C 5/146; A45C 13/385; A45C 3/004; B62B 3/025

USPC ..... 190/18 A, 18 R, 107, 110, 115; 220/9.2; 383/7, 38; 280/37

See application file for complete search history.

(56) References Cited

U.S. PATENT DOCUMENTS

| | | | | |
|---|---|---|---|---|
| 4,813,520 | A * | 3/1989 | Lin | A45C 5/14 190/107 |
| 6,401,890 | B1 * | 6/2002 | Tan | A45C 5/14 150/159 |
| 6,604,617 | B2 | 8/2003 | Davis et al. | |
| 7,849,984 | B2 | 12/2010 | Whalen et al. | |
| 2005/0016810 | A1 * | 1/2005 | Feng | A45C 7/0036 190/115 |
| 2005/0284718 | A1 * | 12/2005 | Tai | A45C 7/0077 190/107 |
| 2014/0353947 | A1 * | 12/2014 | Frankel | B62B 3/027 280/651 |
| 2015/0014965 | A1 * | 1/2015 | Gibson | B62B 1/002 280/651 |
| 2015/0108739 | A1 * | 4/2015 | Kassab Arabo | B62B 3/00 280/651 |

* cited by examiner

*Primary Examiner* — Fenn C Mathew
*Assistant Examiner* — Cynthia F Collado
(74) *Attorney, Agent, or Firm* — Hamre, Schumann, Mueller & Larson, P.C.

(57) ABSTRACT

A collapsible luggage includes a rigid base, a plurality of wheel members, a flexible body, and a telescopic rod unit. The rigid base defines a receiving space. The flexible body includes two side segments and opposite front and rear segments. The telescopic rod unit is disposed on one of the side segments of the flexible body, and is pivotable relative to the base between an unfolded position, where the flexible body is expanded so that the flexible body and the base cooperatively define an accommodating space, and a folded position, where the flexible body is collapsed, and the telescopic rod unit and the flexible body are received in the receiving space.

11 Claims, 6 Drawing Sheets

COLLAPSIBLE LUGGAGE

CROSS-REFERENCE TO RELATED APPLICATION

This application claims priority of Chinese Patent Application No. 201620517522.3, filed on May 31, 2016.

FIELD

The disclosure relates to a luggage, and more particularly to a collapsible luggage including a rigid base.

BACKGROUND

Luggages or suitcases are often used for carrying personal items or articles, and for protecting the personal items or articles from damage when subjected to an external impact force. Therefore, a conventional luggage typically includes an integrally-formed hard shell that constitutes a body of the conventional luggage. However, the conventional luggage has a fixed volume and normally occupies a considerable amount of space, which is inconvenient when it comes to storage or transport of the conventional luggage.

To resolve this issue, collapsible luggages with adjustable volume size are designed, such as those disclosed in U.S. Patent Publication No. 20050016310, and U.S. Pat. Nos. 6604617B2 and 7849984B2. A conventional collapsible luggage typically includes a bottom part which is collapsible such that a distance between opposite front and rear parts of the conventional collapsible luggage is adjustable, and a volume of the conventional collapsible luggage can be reduced. However, since the bottom part of the conventional collapsible luggage is adapted to bear weight of the personal items or articles received in the conventional collapsible luggage, and is adapted for a plurality of wheels or a standing frame to be mounted thereon, the configuration of the bottom part being collapsible adversely affects the structural strength of the conventional collapsible luggage. Furthermore, since the rear part of the conventional collapsible luggage is typically mounted with a telescopic rod and is thus uncollapsible, and since an area of the rear part is typically larger than that of the bottom part, the conventional collapsible luggage still occupies a considerable amount of space even when the bottom part is collapsed.

SUMMARY

Therefore, an object of the disclosure is to provide a collapsible luggage that can alleviate at least one of the drawbacks of the prior arts.

According to the disclosure, the collapsible luggage includes a rigid base, a plurality of wheel members, a flexible body, and a telescopic rod unit. The rigid base includes a base wall, and a surrounding wall that extends upwardly from the base wall, that has two short edges and two long edges interconnecting the short edges, and that, cooperates with the base wall to define a receiving space. The wheel members are disposed on a bottom surface of the base wall. The flexible body includes two side segments that are respectively connected to the snort edges of the surrounding wall, and opposite front and rear segments that are respectively connected to the long edges of the surrounding wall and that interconnect the side segments. The telescopic rod unit is disposed on the flexible body, and has a pivot end that is pivotally connected to one of the short and long edges of the surrounding wall. The telescopic rod unit is pivotable relative to the one of the short and long edges between an unfolded position and a folded position.

When the telescopic rod unit is at the unfolded position, the telescopic rod unit is substantially perpendicular to the base wall, and the flexible body is expanded so that the flexible body and the base cooperatively define an accommodating space, and that the collapsible luggage is transformed to an expanded state.

When the telescopic rod unit is at the folded position, the flexible body is collapsed, and the telescopic rod unit and the flexible body are received in the receiving space of the base so that the collapsible luggage is transformed to a collapsed state.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
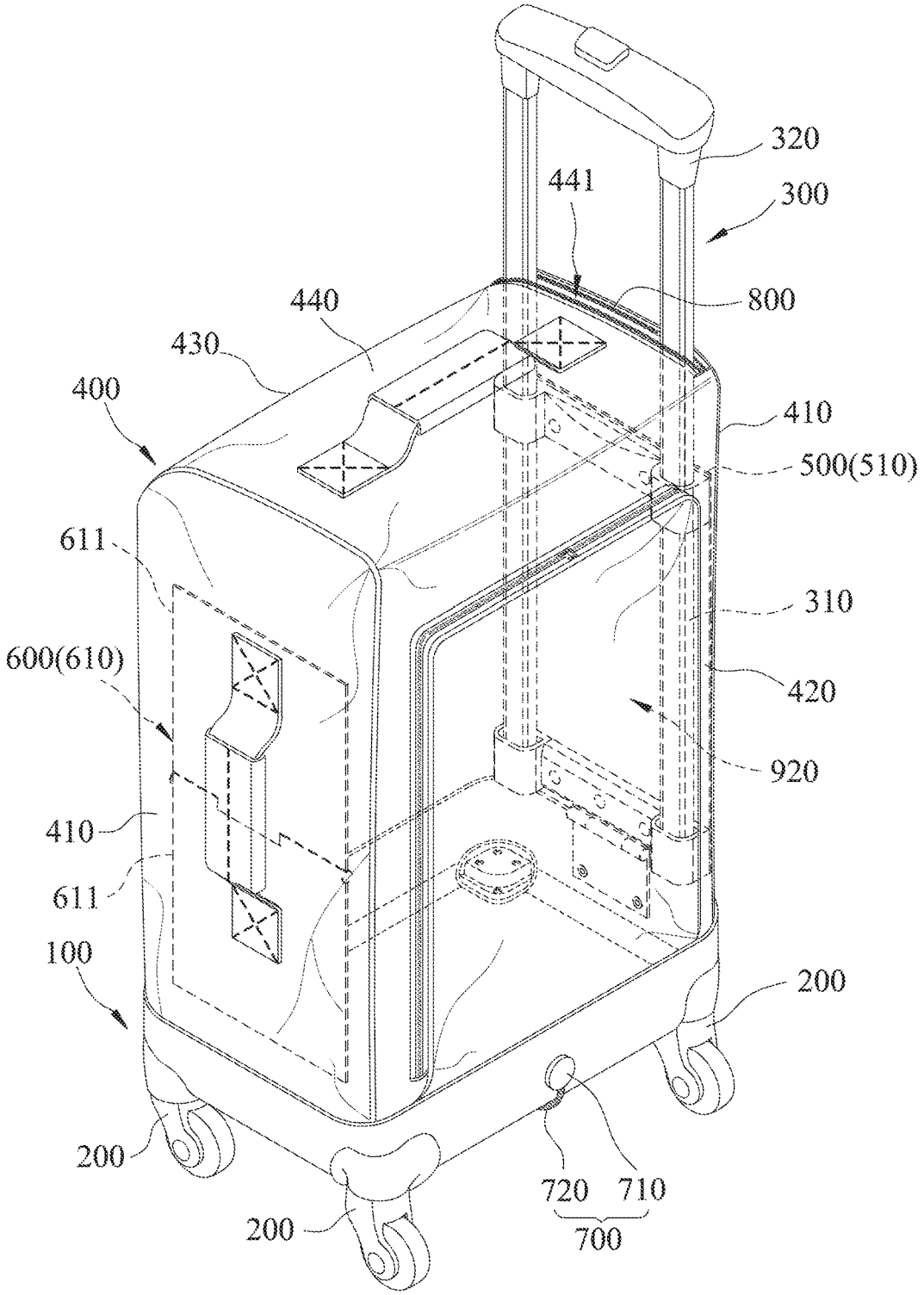
FIG. 1 is a perspective view of an embodiment of a collapsible luggage according to the disclosure, illustrating the collapsible luggage in an expanded state and a grip of a telescopic rod unit of the collapsible luggage at an extended position.

Referring to FIG. 1, an embodiment of a collapsible luggage according to the disclosure includes a rigid base 100, a plurality of wheel members 200, a flexible body 400, a zipper 800, a telescopic rod unit 300, a first reinforcing unit 500, a second reinforcing unit 600, and a restraining device 700.

Figure 2:
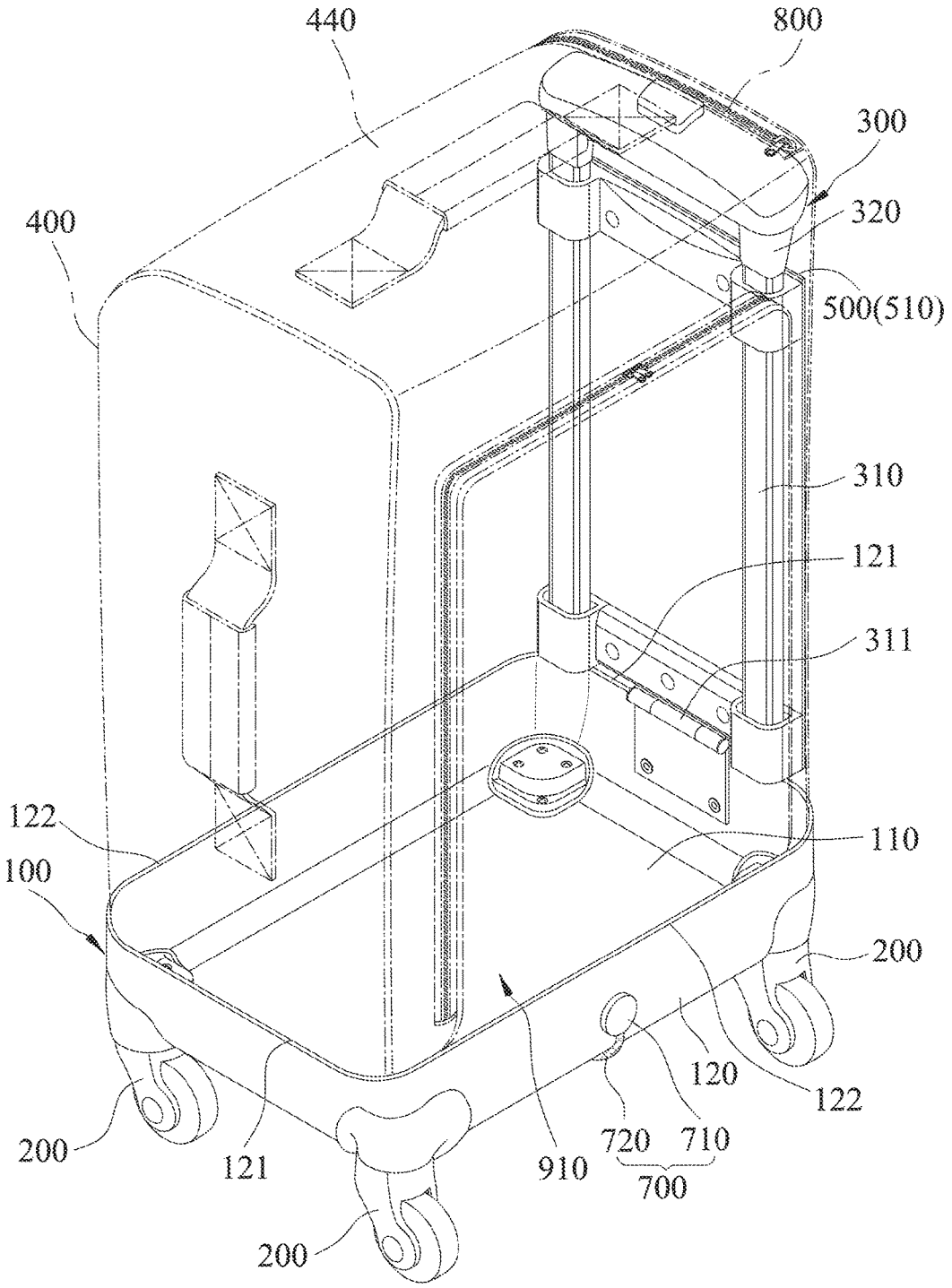
FIG. 2 is a perspective view of a base, multiple wheel members and the telescopic rod unit of the embodiment, illustrating the telescopic rod unit at an unfolded position and the grip at a retracted position.

With further reference to FIG. 2, the base 100 includes a base wall 110, and a surrounding wall 120 that extends upwardly from the base wail 110, and that has two short edges 121 and two long edges 122 interconnecting the short edges 121. The base wail 110 and the surrounding wall 120 cooperatively define a receiving space 910 therein. The base 100 is made by injection molding using a plastic material selected from, polyethylene (PE), polypropylene (PP), polycarbonate (PC), ethylene vinyl acetate (EVA), polyvinyl chloride (PVC), and acrylonitrile-butadiene-styrene (ABS) resin. Alternatively, the base 100 is made by compression molding using a metal such as aluminum, or iron, etc. The base 100 is integrally formed as one piece and is rigid in structure.

The wheel members 200 are disposed on a bottom surface of the base wall 110. In this embodiment, the number of the wheel members 200 is four. In certain embodiments, the number of the wheel members 200 may be two, three, or greater than four, with no particular restriction thereto.

In this embodiment, a distance between a top surface of the base 100 and a bottom end of any of the wheel members 200 is not greater than 10 inches. That is, the base 100 has a height that is certainly not greater than 10 inches. Such design specification permits a user to conveniently carry or store the collapsible luggage. In certain embodiments, the distance is not limited to being 10 inches, and may vary according to actual design requirements.

It is worth mentioning that in order to meet such design specification, the base wall 110 of the base 100 can be grooved from the bottom surface at positions corresponding to where the wheel members 200 are disposed. As such, the size of the wheel members 200 is not restricted by the height of the base 100, and that the volume of the receiving space 910 is not compromised, since the bottom surface of the base wall 110 does not have to be at the same height level as a top end of any of the wheel members 200. Moreover, the base 100 and the wheel members 200 may have an improved coupling strength.

The flexible body 400 includes two side segments 410, opposite front and rear segments 420, 430, and a top segment 440. The side segments 410 are respectively connected to the short edges 121 of the surrounding wall 120 of the base 100. The front and rear segments 420, 430 are respectively connected to the long edges 122 of the surrounding wall 120, and interconnect the side segments 410. The top segment 440 interconnects top ends of the side segments 410, the front segment 420, and the rear segment 430. The flexible body 400 is made of a material selected from TTC fabric, Mutispandex, woven fabric, leather, single or composite polyurethane (PU), styrene-butadiene rubber (SEP.), and rubber, etc., so that the flexible material is both flexible and waterproof. The flexible body 400 has an opening 441. In this embodiment, the opening 441 is formed in the top segment 440.

The zipper 300 is disposed at the opening 441 for covering and uncovering the opening 441.

The telescopic rod unit 300 is disposed, on one of the side segments 410 of the flexible body 400, and has a pivot end 311 that is pivotally connected to one of the short edges 121 of the surrounding wall 120 which is adjacent to the one of the side segments 410 of the flexible body 400. The telescopic rod unit 300 is pivotable relative to the one of the short, edges 121 between an unfolded position (see FIG. 2) and a folded position (see FIG. 5). When the telescopic rod unit 300 is at the unfolded position, the telescopic rod unit 300 is substantially perpendicular to the base wall 110, and the flexible body 400 is expanded so that the flexible body 400 and the base 100 cooperatively define an accommodating space 920 (see FIG. 1), and that the collapsible luggage is transformed to an expanded state. When the telescopic rod unit 300 is at the folded position, the flexible body 400 is collapsed, and the telescopic rod unit 300 and the flexible body 400 are received in the receiving space S10 of the base 100 so that the collapsible luggage is transformed to a collapsed state.

In greater detail, the telescopic rod unit 300 includes a frame 310 that has the pivot end 311, and a grip 320 that is telescopically movable relative to the frame 310 between an extended position (see FIG. 1) and a retracted position (see FIG. 2). When the collapsible luggage is in the expanded state and the grip 320 is at the retracted position, the grip 320 is concealed and does not protrude from the top segment 440 of the flexible body 400. When the collapsible luggage is in the expanded state and the grip 320 is at the extended position, the grip 320 extends through the opening 441 and protrudes from the top segment 440 of the flexible body 400.

It should be noted that in other modification of the embodiment, the telescopic rod unit 300 may be disposed on a selected one of the front and rear segments 420, 430 of the flexible body 400, and the pivot end 311 of the telescopic rod unit 300 may be pivotally connected to one of the long edges 122 of the surrounding wall 120 which is adjacent to the selected one of the front and rear segments 420, 430 of the flexible body 400.

The first reinforcing unit 500 includes a reinforcing board 510 that is disposed between the telescopic rod unit 300 and the one of the side segments 410 of the flexible body 400, and that is co-movable with the telescopic rod unit 300.

Figure 4:
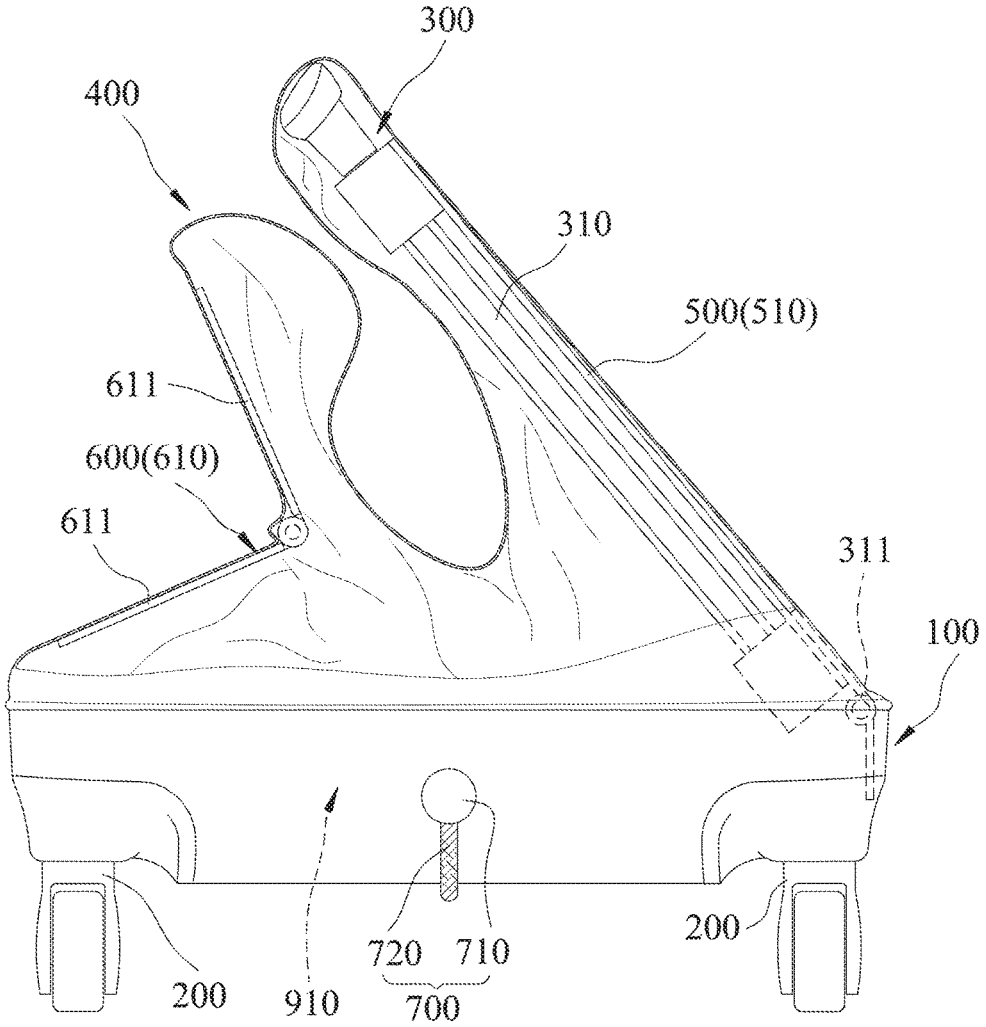
FIG. 4 is a partly sectional side view of the embodiment, illustrating a reinforcing board of a reinforcing unit being folded when the collapsible luggage is transformed between the expanded state and a collapsed state.

The second reinforcing unit 600 includes a reinforcing board 610 that has two board portions 611 disposed on the other one of the side segments 410 of the flexible body 400 which is opposite to the telescopic rod unit 300. As shown in FIG. 4, the board portions 611 of the reinforcing board 610 of the second reinforcing unit 600 are, but not limited to be, hinged together.

Referring back to FIG. 2, the restraining device 700 includes two fixation seats 710 (only one of the fixation seats 710 is shown in FIG. 2) and an elastic strip 720. The fixation seats 710 are opposite to each other and are rotatably mounted on the surrounding wail 120 of the base 100. The elastic strip 720 interconnects the fixation seat s 710. The fixation seats 710 are rotatable along with the elastic strip 720 relative to the base 100 so that the elastic strip 720 can be operated to flip to a top surface of the base 100 in an unobstructed and convenient manner.

Figure 3:
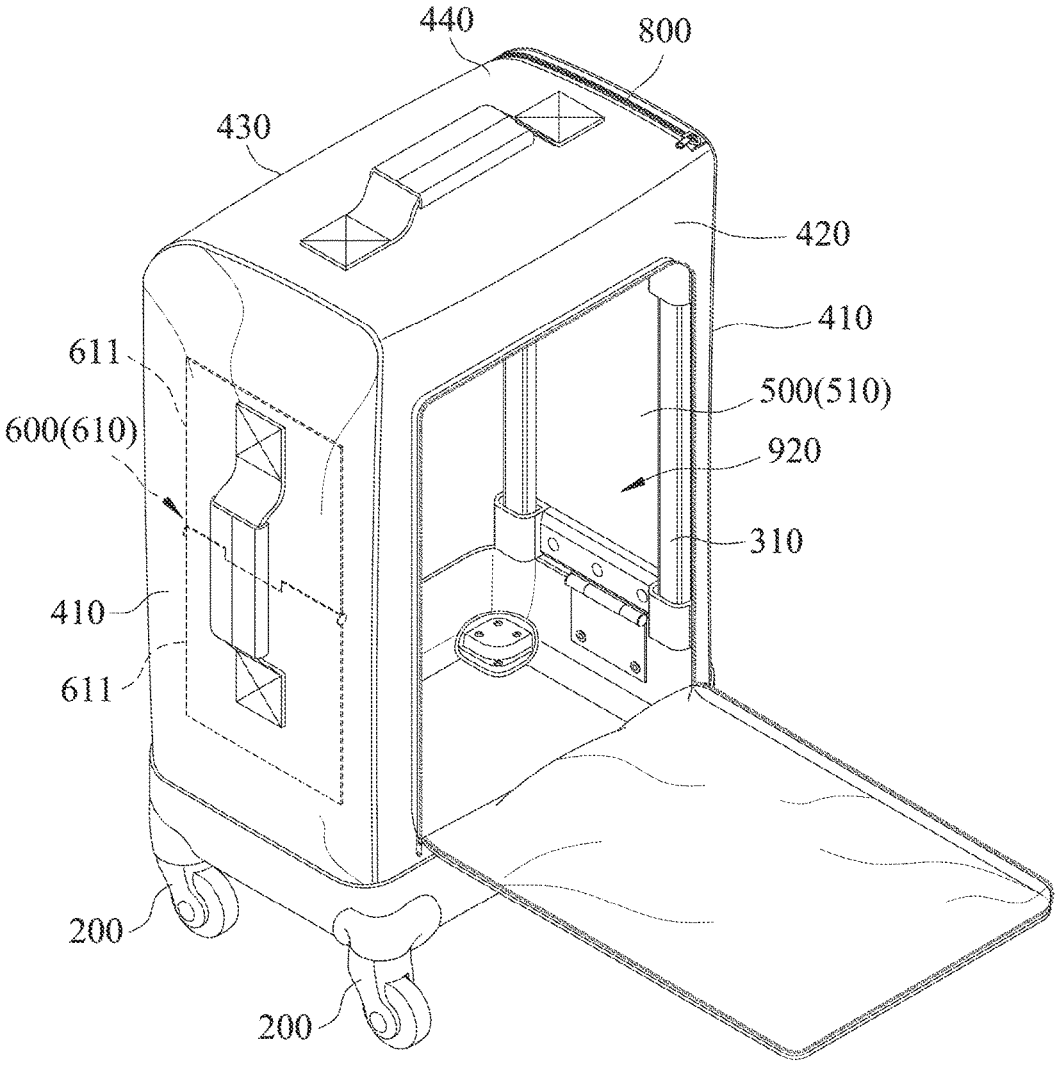
FIG. 3 is a perspective view of the embodiment, illustrating the collapsible luggage in the expanded state and a front segment of a flexible body of the embodiment being opened.

Referring to FIGS. 2 and 3, when it is desired to transform the collapsible luggage from the collapsed state to the expanded state for use, the flexible body 400 and the telescopic rod unit 300 are first pulled away from the receiving space S10 of the base 100 until the telescopic rod unit 300 reaches the unfolded position (see FIG. 2). At this time, the reinforcing board 510 of the first reinforcing unit 500 stands upright, and the reinforcing board 610 of the second reinforcing unit 600 is unfolded to support the other one of the side segments 410 of the flexible body 400. In this way, each of the side segments 410 has a level surface. At this time, the collapsible luggage is in the expanded state, the grip 320 is at the retracted position, and the elastic strip 720 is in contact with the bottom surface of the base 100. The zipper 800 can be unzipped so that the grip 320 can be pulled out through the opening 441 until the grip 320 is moved to the extended position (see FIG. 1). As such, the collapsible luggage can be pulled and moved around in a convenient manner.

Figure 5:
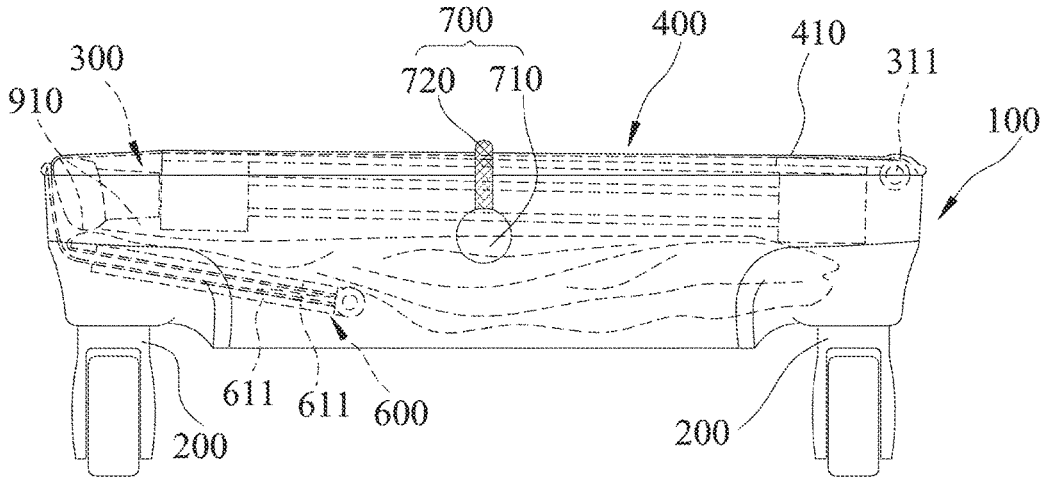
FIG. 5 is a schematic side view of the embodiment, illustrating the collapsible luggage at the collapsed state.
Figure 6:
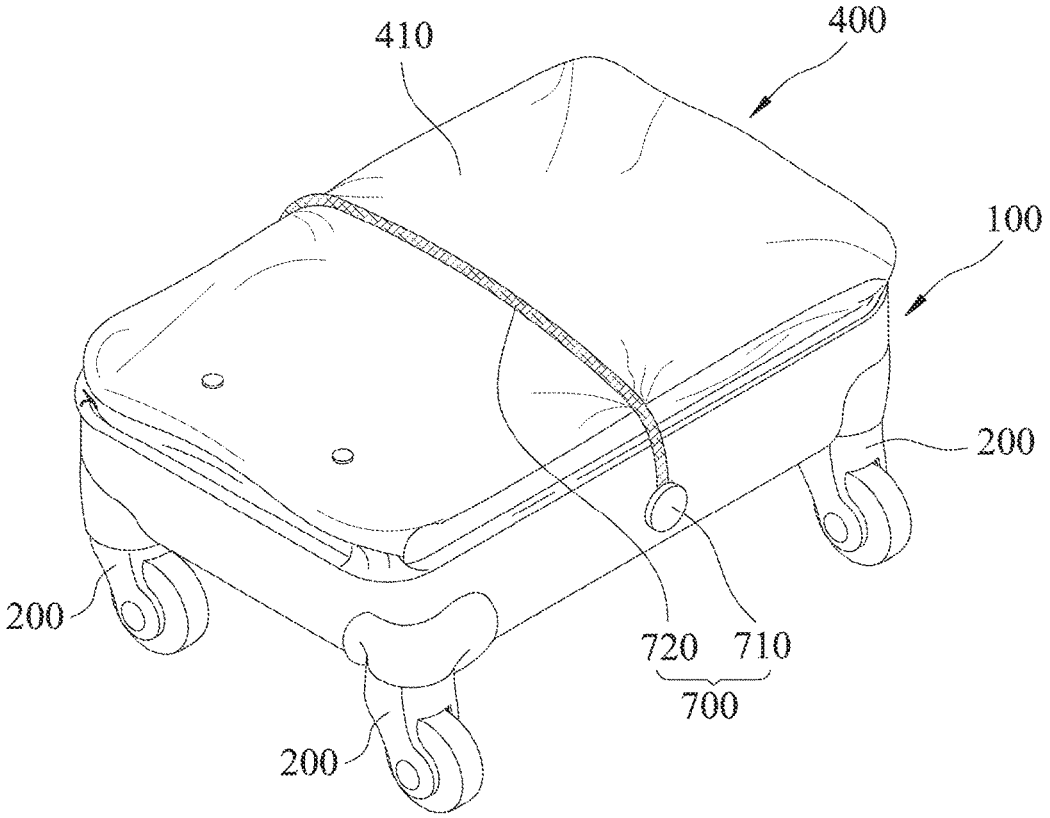
FIG. 6 is a perspective view of the embodiment, illustrating an elastic strap of a restraining device of the collapsible luggage restraining the telescopic rod unit and a flexible body of the collapsible luggage when the collapsible luggage is at the collapsed state.

With further reference to FIG. 4, when it is desired to transform the collapsible luggage to the collapsed state for storage or transport, first, the accommodating space 920 is emptied, the grip 320 is moved to back to the retracted position, and the zipper 800 is zipped to cover the opening 441. Next, the reinforcing board 610 of the second reinforcing unit 600 is folded and moved toward the receiving space 910 so as to permit the flexible body 400 to be collapsed. That is, the front segment 420, the rear segment 430, and the top segment 440 of the flexible body 400 are moved together with one of the side segments 410 which is connected to the second reinforcing unit 600, and are folded into the receiving space 910. In the meantime, the telescopic rod unit 300 moves together with the other one of the side segments 410 and pivots down toward the receiving space 910. When the telescopic rod unit 300 pivots to a position that is flush with the top surface of the base 100, the telescopic rod unit 300 reaches the folded position, as shown in FIG. 5. At this time, the collapsible luggage is in the collapsed state, and the elastic strip 720 can be flipped to the top surface of the base 100 so as to restrain the flexible body 400 and the telescopic rod unit 300 in the receiving space 910, as shown in FIG. 6.

It is worth mentioning that in certain embodiments, the board portions 611 of the reinforcing board 610 of the second reinforcing unit 600 may be spaced apart and not connected to each other. When the collapsible luggage is transformed to the collapsed state, the board portions 611 of the reinforcing board 610 are stacked one above the other and are received in the receiving space 910.

In summary, compared with the above-mentioned conventional collapsible luggage with the bottom part being collapsible, the base 100 of the collapsible luggage of the embodiment is not collapsible and serves mainly to bear weight of articles disposed thereon. Therefore, the base 100 which is formed as one piece has enhanced structural integrity, improved durability, and reduced manufacturing cost.

In addition, when the collapsible luggage is in the collapsed state, the telescopic rod unit 300 and the flexible body 400 are received in the receiving space 910 of the base 100 so that the collapsible luggage possesses a smallest possible volume. By virtue of the elastic strip 720, the telescopic rod unit 300 and the flexible body 400 are restrained in the receiving space 910 and are prevented from, expanding, thereby providing a streamlined appearance and convenience in transport or storage. Furthermore, due to the compact size of the collapsible luggage, the cost of transporting or shipping the collapsible luggage may be reduced.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that, in the description, various features are sometimes grouped together in a single embodiment, Figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A collapsible luggage comprising:

a rigid base including a base wall, and a surrounding wall that extends upwardly from said base wall, that has two short edges and two long edges interconnecting said short edges, and that cooperates with said base wall to define a receiving space;

a plurality of wheel members disposed on a bottom surface of said base wall;

a flexible body including two side segments that are respectively connected to said short edges of said surrounding wall, and opposite front and rear segments that are respectively connected to said long edges of said surrounding wall and that interconnect said side segments; and a telescopic rod unit disposed on said flexible body, and having a pivot end that is pivotally connected to one of said short and long edges of said surrounding wall, said telescopic rod unit being pivotable relative to said one of said short and long edges between an unfolded position and a folded position, said telescopic rod unit is disposed on one of said side segments of said flexible body, said pivot end of said telescopic rod unit being pivotally connected to one of said short edges of said surrounding wall which is adjacent to said one of said side segments of said flexible body; and a first reinforcing unit including a reinforcing board that is disposed between said telescopic rod unit and said one of said side segments of said flexible body, and that is co-movable with said telescopic rod unit, wherein, when said telescopic rod unit is at the unfolded position, said telescopic rod unit is substantially perpendicular to said base wall, and said flexible body is expanded so that said flexible body and said base cooperatively define an accommodating space, and that said collapsible luggage is transformed to an expanded state, and wherein, when said telescopic rod unit is at the folded position, said flexible body is collapsed, and said telescopic rod unit and said flexible body are received in said receiving space of said base so that said collapsible luggage is transformed to a collapsed state.

2. The collapsible luggage as claimed in claim 1, further comprising:

a second reinforcing unit including a reinforcing board that has two board portions disposed on the other one of said side segments of said flexible body which is opposite to said telescopic rod unit, wherein when said telescopic rod unit is at the unfolded position, said reinforcing board of said second reinforcing unit is unfolded to support the other one of said side segments of said flexible body, and wherein when said telescopic rod unit is at the folded position, said reinforcing board of said second reinforcing unit is folded so as to permit said flexible body to be collapsed.

3. The collapsible luggage as claimed in claim 2, wherein said board portions of said reinforcing board of said second reinforcing unit are hinged together.

4. The collapsible luggage as claimed in claim 1, wherein said flexible body further includes a top segment that interconnects top ends of said side segments, said front segment, and said rear segment.

5. The collapsible luggage as claimed in claim 4, wherein:

said flexible body has an opening, said telescopic rod unit includes a frame that has said pivot end, and a grip that is telescopically movable relative to said frame between an extended position and a retracted position, when said collapsible luggage is in the expanded state and said grip is at the retracted position, said grip is concealed and does not protrude from said top segment of said flexible body, and when said collapsible luggage is in the expanded state and said grip is at the extended position, said grip extends through said opening and protrudes from said top segment of said flexible body.

6. The collapsible luggage as claimed in claim 5, wherein said opening of said flexible body is formed in said top segment.

7. The collapsible luggage as claimed in claim 5, wherein said collapsible luggage further comprises a zipper disposed at said opening for covering and uncovering said opening.

8. The collapsible luggage as claimed in claim 1, further comprising:

a restraining device including two fixation seats that are rotatably mounted on said surrounding wall of said base, and an elastic strip that interconnects said fixation seats, wherein when said collapsible luggage is in the expanded state, said elastic strip is in contact with said bottom surface of said base, and wherein when said collapsible luggage is in the collapsed state, said elastic strip is flipped to a top surface of said base so as to restrain said flexible body and said telescopic rod unit in said receiving space.

9. The collapsible luggage as claimed in claim 1, wherein said base has a height not greater than 10 inches.

10. The collapsible luggage as claimed in claim 9, wherein a distance between a top surface of said base and a bottom end of any of said wheel members is not greater than 10inches.

11. A collapsible luggage comprising:

a rigid base including a base wall, and a surrounding wall that extends upwardly from said base wall, that has two short edges and two long edges interconnecting said short edges, and that cooperates with said base wall to define a receiving space;

a plurality of wheel members disposed on a bottom surface of said base wall;

a flexible body including two side segments that are respectively connected to said short edges of said surrounding wall, and opposite front and rear segments that are respectively connected to said long edges of said surrounding wall and that interconnect said side segments; and a telescopic rod unit disposed on said flexible body, and having a pivot end that is pivotally connected to one of said short and long edges of said surrounding wall, said telescopic rod unit being pivotable relative to said one of said short and long edges between an unfolded position and a folded position; and a restraining device including two fixation seats that are rotatably mounted on said surrounding wall of said base, and an elastic strip that interconnects said fixation seats, wherein, when said telescopic rod unit is at the unfolded position, said telescopic rod unit is substantially perpendicular to said base wall, and said flexible body is expanded so that said flexible body and said base cooperatively define an accommodating space, and that said collapsible luggage is transformed to an expanded state, wherein, when said telescopic rod unit is at the folded position, said flexible body is collapsed, and said telescopic rod unit and said flexible body are received in said receiving space of said base so that said collapsible luggage is transformed to a collapsed state, wherein when said collapsible luggage is in the expanded state, said elastic strip is in contact with said bottom surface of said base, and wherein, when said collapsible luggage is in the collapsed state, said elastic strip is flipped to a top surface of said base so as to restrain said flexible body and said telescopic rod unit in said receiving space.

* * * * *